US006371700B1

(12) United States Patent
Rich

(10) Patent No.: US 6,371,700 B1
(45) Date of Patent: Apr. 16, 2002

(54) RETAINING WALL SYSTEM

(75) Inventor: Gordon Rich, Cincinnati, OH (US)

(73) Assignee: Reading Rock, Incorporated, Cincinnati, OH (US)

( * ) Notice: Subject to any disclaimer, the term of this patent is extended or adjusted under 35 U.S.C. 154(b) by 0 days.

(21) Appl. No.: 09/408,665

(22) Filed: Sep. 29, 1999

(51) Int. Cl.[7] ..... E02D 17/20

(52) U.S. Cl. ..... 405/284; 52/605; 52/606; 52/607

(58) Field of Search ..... 52/604, 605, 606, 52/607, 608, 610, 596, 503; 405/284, 286, 15–17, 20

(56) References Cited

U.S. PATENT DOCUMENTS

| | | | | | |
|---|---|---|---|---|---|
| 835,669 | A | * | 11/1906 | Eckley | 52/607 |
| 1,802,874 | A | * | 4/1931 | Casey et al. | 52/607 |
| 2,703,487 | A | * | 3/1955 | Ossoinack | 52/607 |
| 4,802,320 | A | * | 2/1989 | Forsberg | 52/608 |
| 4,825,619 | A | * | 5/1989 | Forsberg | 405/286 |
| 5,115,614 | A | * | 5/1992 | McGrath | 52/606 |
| 5,154,032 | A | * | 10/1992 | Ritter | 52/605 |
| RE34,314 | E | * | 7/1993 | Forsberg | 405/286 |
| 5,425,600 | A | * | 6/1995 | Gordon | 405/284 |
| 5,484,235 | A | * | 1/1996 | Hilfiker et al. | 405/284 |
| 5,499,891 | A | * | 3/1996 | Klenert | 405/284 |
| 5,505,034 | A | * | 4/1996 | Dueck | 52/604 |
| 5,620,283 | A | * | 4/1997 | Walter | 405/286 |
| 5,623,797 | A | * | 4/1997 | Gravier et al. | 52/284 |
| 5,658,098 | A | * | 8/1997 | Woolbright | 405/284 |
| 5,788,423 | A | * | 8/1998 | Perkins | 405/284 |
| 5,852,906 | A | * | 12/1998 | Kuban | 52/607 |
| 5,941,042 | A | * | 8/1999 | Dueck | 52/604 |
| 6,019,550 | A | * | 2/2000 | Wrigley et al. | 405/284 |
| 6,065,265 | A | * | 5/2000 | Stenekes | 52/606 |
| 6,082,933 | A | * | 7/2000 | Maguire et al. | 405/286 |
| 6,089,792 | A | * | 7/2000 | Khamis | 405/284 |
| 6,113,318 | A | * | 9/2000 | Guth | 405/284 |

OTHER PUBLICATIONS

Gravity Retaining Walls Incorporated, Advertisement for Secura Slope, (Date unknown).
Gravity Retaining Walls Incorporated, Advertisement for Trangolo, (Date unknown).
Gravity Retaining Walls Incorporated, Advertisement for Crossbow, (Date unknown).
Soil Retention Products, Brochure for Verdura, (Date unknown).
Annual accounts in the Black for the 'Alpenstein' Group, CPI—Concrete Plant International No. 2/1999, p. 140.
Advertisements, LASN Marketplace, Jun. 1999, pp. 92–94.
Reading Rock Incorporated, Brochure for Jumbo Nursery Stone. (Date Unknown).
Allan Block Corporation, Advertisement, (Date unknown).

* cited by examiner

*Primary Examiner*—Thomas B. Will
*Assistant Examiner*—Alexandra K. Pechhold
(74) *Attorney, Agent, or Firm*—Frost Brown Todd LLC

(57) ABSTRACT

A retaining wall system comprised of units having a front planter compartment with a drainage channel, and a rear hydro-drainage compartment. The front planter compartment accepts soil and vegetation therein, and the drainage channel drains water and other fluids from the first compartment into the second compartment to prevent hydrostatic pressure from building up within the front compartment. The rear hydro-drainage compartment is open on its bottom for draining and may be filled with angular gravel or other hydro-drainage aggregate to properly weight units to maintain unit placement. The units contain angle of installation guides that aid in vertically aligning the units to achieve a desired face setback, and angularly aligning the units to achieve a desired angle of repose between layers of units. The units contain horizontal alignment guides to aid in side-to-side unit placement. The units are of a sufficient weight that the unit weight along with the angle of installation guides and horizontal guides reduces unit slippage without the use of interlocking means or mortar. A wall of up to eight feet may be built without the use of geogrid in accordance with the present invention.

2 Claims, 7 Drawing Sheets

BLOCK WALL ANALYSIS RESULTS

| BLOCK LENGTH (in) | BLOCK WIDTH (in) | BLOCK HEIGHT (in) | FACE SETBACK (in) | WALL INCLINATION[a] (degrees) | SR WALL METHOD (BASED ON HINGE HEIGHT) | | HCN METHOD (HINGE HEIGHT NOT CONSIDERED) | | | HCN RECOMMENDED | |
|---|---|---|---|---|---|---|---|---|---|---|---|
| | | | | | MAXIMUM SAFE TOTAL HEIGHT[b] | EQUIVALENT NUMBER OF COURSES | MAXIMUM THEORETICAL SAFE TOTAL HEIGHT[b] | EQUIVALENT NUMBER OF COURSES | MINIMUM CONTROLLING FACTOR OF SAFETY (SLIDING) | MAXIMUM ALLOWABLE EXPOSED WALL HEIGHT[c] | EQUIVALENT NUMBER OF COURSES |
| 21.63 | 18.00 | 7.00 | 2.55 | 20 | 6'-5" | 11 | 8'-2" | 14 | 1.68 | 7'-7" | 13 |
| | | | 3.26 | 25 | 6'-5" | 11 | 7'-7" | 13 | 1.85 | 7'-0" | 12 |
| | | | 4.03 | 30 | 6'-5" | 11 | 7'-0" | 12 | 2.09 | 6'-5" | 11 |
| 22.63 | 18.00 | 7.00 | 2.55 | 20 | 7'-0" | 12 | 8'-2" | 14 | 1.71 | 7'-7" | 13 |
| | | | 3.26 | 25 | 6'-5" | 11 | 7'-7" | 13 | 1.89 | 7'-0" | 12 |
| | | | 4.03 | 30 | 6'-5" | 11 | 7'-0" | 12 | 2.13 | 6'-5" | 11 |
| 23.63 | 18.00 | 7.00 | 2.55 | 20 | 7'-7" | 13 | 8'-9" | 15 | 1.68 | 8'-2" | 14 |
| | | | 3.26 | 25 | 7'-0" | 12 | 8'-2" | 14 | 1.84 | 7'-7" | 13 |
| | | | 4.03 | 30 | 6'-5" | 11 | 7'-7" | 13 | 2.06 | 7'-0" | 12 |

(a) WALL INCLINATION IS MEASURED FROM VERTICAL.
(b) MAXIMUM SAFE TOTAL HEIGHT MEASURED FROM TOP OF FOOTING OR FROM BASE OF BOTTOM BLOCK
(c) MAXIMUM ALLOWABLE HEIGHT ABOVE GROUND SURFACE

FIG. 9

RETAINING WALL SYSTEM

FIELD OF THE INVENTION

This invention relates to a segmental retaining wall system comprised of units and specifically to a segmental retaining wall system comprised of multiple units having a planter compartment with a drainage channel and a hydro-drainage compartment.

BACKGROUND OF THE INVENTION

Retaining wall systems are often comprised of multiple units planted into a hillside or embankment in layers to form a retaining wall system to prevent erosion of the hillside or embankment.

Typically, the individual units forming the retaining wall system are substantially rectangular in shape, however, other shapes including substantially triangular or substantially oval are also known in the art. The units are often comprised of four walls and a bottom forming a single compartment that is open on its top, and may be filled with gravel, soil, and/or vegetation. Vegetation is sometimes planted to provide a natural appearance and/or to partially cover the wall. Often the units have a decorative front face that has a greater height than the other three walls.

To build a retaining wall system with said units, the units are laid side-by-side and placed in layers. Layers may be laid in different angles and depths within the hillside or embankment such that different layers within a wall may have different angles of repose and different face setbacks. Walls may be built in patterns such as staircase, slope or curve pattern. Geogrid, which is a woven synthetic fiber, is often placed between layers to extend into the hillside or embankment behind the wall to give the wall sufficient strength to be built above a height of approximately three to four feet, which is typically the maximum wall height that may be built without geogrid. The units also typically contain lips or other interlocking means to aid in unit placement in building the wall and aid in preventing unit slippage over time.

However, retaining wall systems in the prior art often erode due to hydrostatic forces causing unit slippage. Precipitation from natural or artificial sources may accumulate within units, exerting outward lateral forces upon the walls of the units, causing the units to erode from their places within the retaining wall system. Increasing the angle of repose and face setback between layers of units increases wall failure when combined with hydrostatic forces.

Another problem with the retaining wall systems in the prior art is that when building a wall it is difficult to position units with the proper side-to-side distance between units, face setback, and angle of repose. It is also difficult to maintain proper side-to-side distance, face setback, and angle of repose over time. Prior art units often have lips or other interlocking means to connect units, or are affixed together with mortar in an attempt to prevent unit slippage. However, without interlocking means or mortar, unit slippage commonly occurs.

In view of the foregoing limitations and shortcomings of the prior art, as well as other disadvantages not specifically mentioned above, it should be apparent that there exists a need for a segmental retaining wall system, comprised of units containing draining means to prevent large hydrostatic pressure from building within the units, thereby minimizing unit slippage.

There exists a need for a retaining wall system having units of sufficient strength to allow a wall of more than three to four feet in height to be built without the use of geogrid and allow for a greater allowable angle of repose and face setback between layers of units.

There exists a need for units that contain means for easily positioning the units with proper side-to-side distance, face setback, and angle of repose.

There also exists a need for units that contain means for maintaining proper side-to-side distance, face setback, and angle of repose, and which resist slippage without the use of interlocking means or mortar.

These and other objects are met by the present invention.

SUMMARY OF THE INVENTION

Briefly described, the retaining wall system of the present invention is comprised of units having a front planter compartment with a drainage channel, and a rear hydro-drainage compartment. The front planter compartment accepts soil and vegetation therein, and the drainage channel drains water and other fluids from the front compartment into the rear compartment to prevent hydrostatic pressure from building up within the front compartment and causing the units to erode. The rear hydro-drainage compartment is open on its bottom for draining and may be filled with angular gravel or other hydro-drainage aggregate to properly weight units to maintain unit placement in the hillside or other embankment. The units contain angle of installation guides that aid in vertically aligning the units to achieve a desired face setback, and angularly aligning the units to achieve a desired angle of repose between layers of units. The units contain horizontal alignment guides to aid in side-to-side unit placement. The units are of a sufficient weight that the unit weight along with the angle of installation guides and horizontal guides reduces unit slippage without the use of interlocking means or mortar. A wall of up to eight feet tall may be built without the use of geogrid in accordance with the present invention.

Additional benefits and advantages of the present invention will become apparent to one skilled in the art to which the present invention relates from the subsequent description of the preferred embodiment and the appended claims, taken in conjunction with the accompanied drawings.

BRIEF DESCRIPTION OF THE DRAWINGS

FIG. 9 is a chart depicting maximum wall height built with units of the present invention.

DETAILED DESCRIPTION OF THE PREFERRED EMBODIMENT

Figure 1:
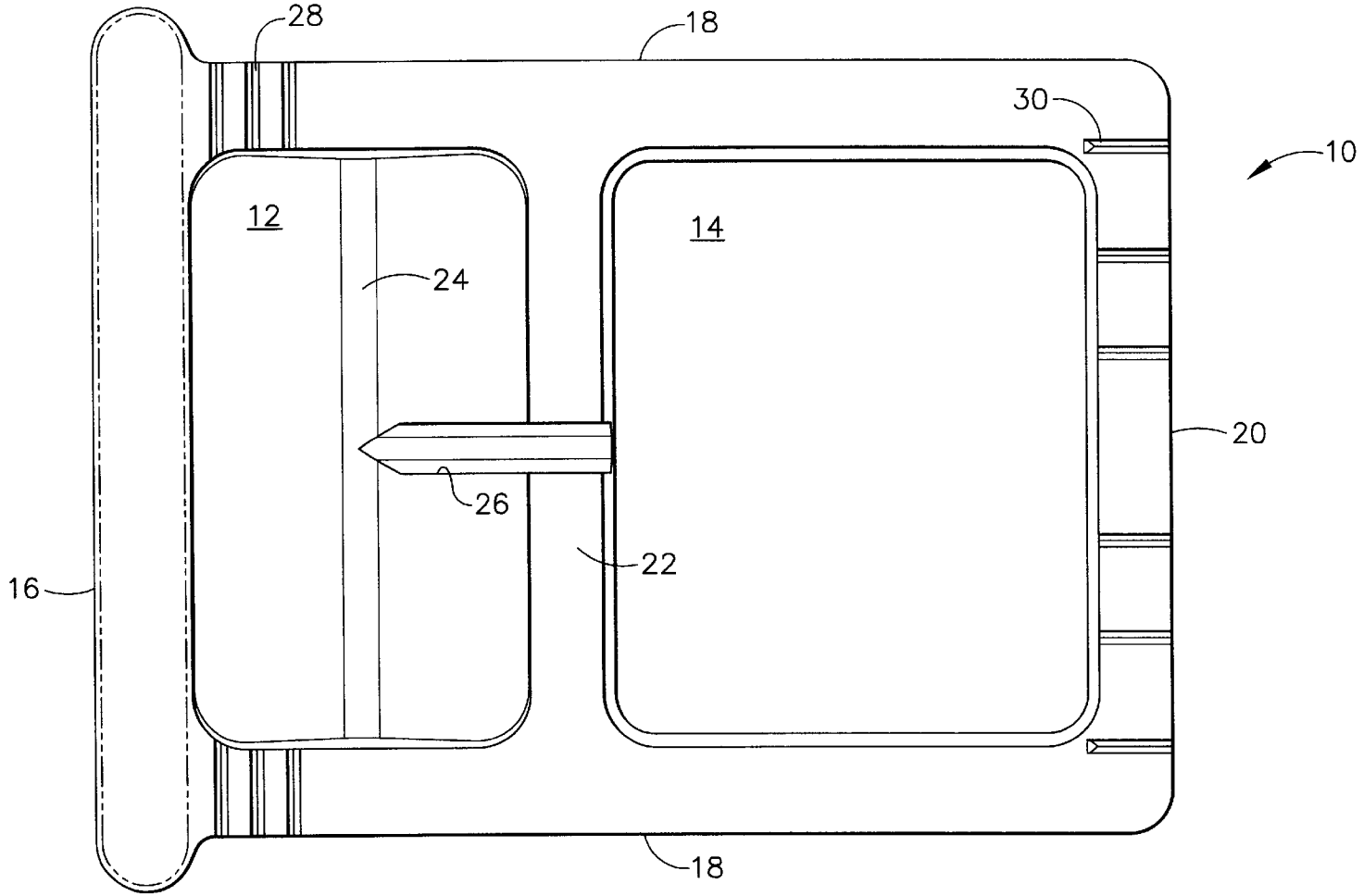
FIG. 1 is a top view of a unit of the present invention showing the front planter compartment, the planter drainage channel, the rear hydro-drainage compartment, the angle of installation guides, and the horizontal alignment guides.

Referring now in detail to the drawings, there is shown in FIG. 1 the unit 10 of the present invention. Unit 10 is comprised of a forward planter compartment 12 and rear hydro-drainage compartment 14, which are formed by front face 16, side walls 18, and rear face 20. Front compartment 12 and rear compartment 14 are separated by middle face 22. Front face 16, rear face 20, middle face 22, and side walls 18 are preferably machine plated in one piece, and made of concrete or other composite material. Preferably units 10 are approximately 102.5 pounds in weight. Units 10 may be of any size, however, preferably units 10 are approximately 22–24 inches long, 18 inches wide, and 7 inches tall. Preferably front compartment 12 is approximately 7.0 inches tall, 12 inches wide and 10.4 inches deep. Preferably rear compartment 14 is approximately 7 inches tall, 12 inches wide, and 10.4 inches deep.

Forward planter compartment 12 is further comprised of front face 16, side walls 18, and middle face 22. Although front face 16 may be of any size, preferably front face 16 is approximately 8.7 inches tall, 18 inches wide, and 2 inches thick. Similarly, although middle face 22 may be of any size capable of separating compartment 12 from compartment 14, preferably middle face 22 is approximately 7 inches tall, 16 inches wide, and 1.5 inches thick. Side walls 18 may of any size of sufficient length to form compartment 12 and compartment 14, and are preferably 20 inches long, 7 inches high, and 1.75 inches thick. Preferably front face 16, side walls 18 and middle face 22 are sized +/−⅛ " of these preferred measurements.

Figure 4:
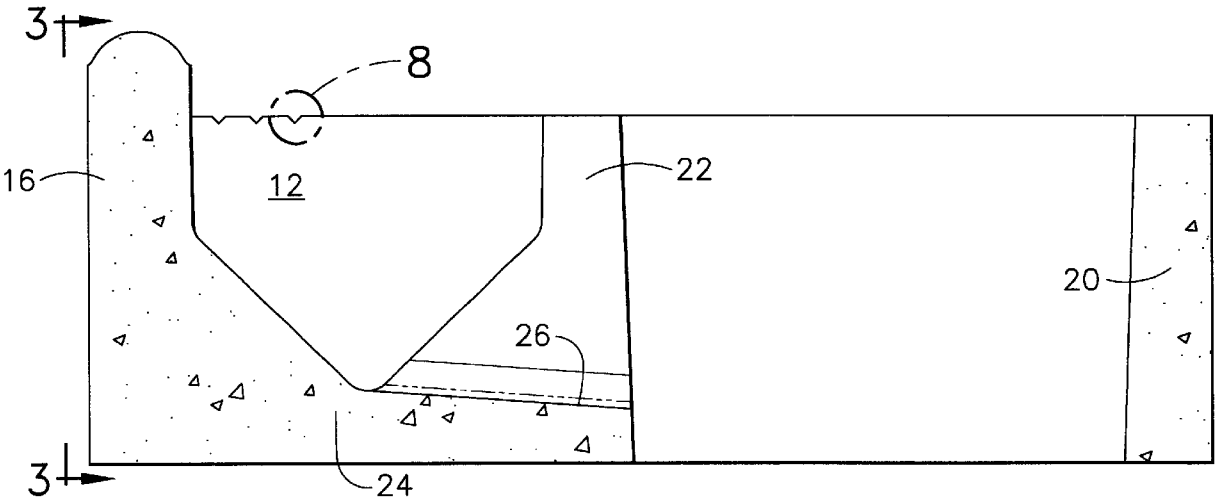
FIG. 4 is a side view of a unit in accordance with the present invention.

As shown in FIG. 4, front face 16 and middle face 22 contain angled portions that taper into bottom portion 24. Bottom portion 24 allows compartment 12 to hold soil, vegetation, and/or other planting materials. Preferably bottom portion 24 is approximately 7.0 inches long and 12.0 inches wide.

There is a drainage channel 26 extending from bottom portion 24 through middle face 22 and into rear compartment 14. Preferably drainage channel 26 is located approximately in the center of middle face 22. Drainage channel 26 is inclined with its highest point at bottom portion 24 so that water and other fluids drain out of compartment 12 into hydro-drainage compartment 14. Preferably drainage channel 26 is approximately 1 inch wide and approximately 0.5 inches deep. In this manner, drainage channel 26 prevents precipitation from accumulating in compartment 12 and exerting outward lateral forces upon front face 16, side walls 18, and middle face 22.

Rear compartment 14 is formed from side walls 18, middle face 22, and rear face 20. Rear compartment 14 is open on its bottom to allow water and other liquids to drain. Preferably rear face 20 is approximately 16 inches long, 7 inches high, and 1.75 inches thick.

Typically, angular gravel, such as #57 crushed limestone or other hydrodrainage material, is placed into rear compartment 14. Angular gravel helps to properly weight unit 10 to hold it into a hillside or embankment, and does not absorb or retain water or other liquids. In this manner, hydrostatic pressure does not build within rear compartment 14.

Figure 8:
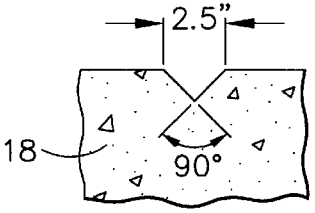
FIG. 8 is a front segmented view showing the angle of installation guides of the present invention.
Figure 3:
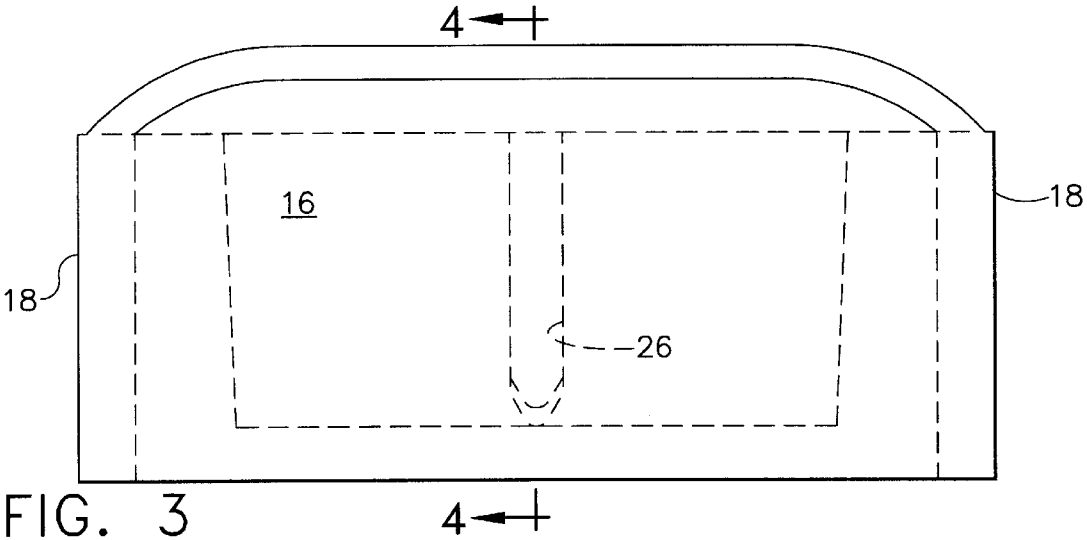
FIG. 3 is a front segmented view showing the drainage channel of the present invention.

Side walls 18 contain angle of installation guides 28 to facilitate in installing units 10 to form a retaining wall system. Guides 28 vertically align and angularly align units 10 when stacked in layers to form a retaining wall. Preferably there are three guides 28 on each side wall 18. Preferably the first guide 28 is positioned approximately 2.5 inches from back of front face 16, middle guide 28 is positioned approximately 3.2 inches from back of front face 16, and rear guide 28 is positioned approximately 4.0 inches from back of front face 16. As shown in FIG. 8, preferably guides 28 are wedge shaped at an angle of 90° and approximately 2.5 inches across at their tops.

Figure 2:
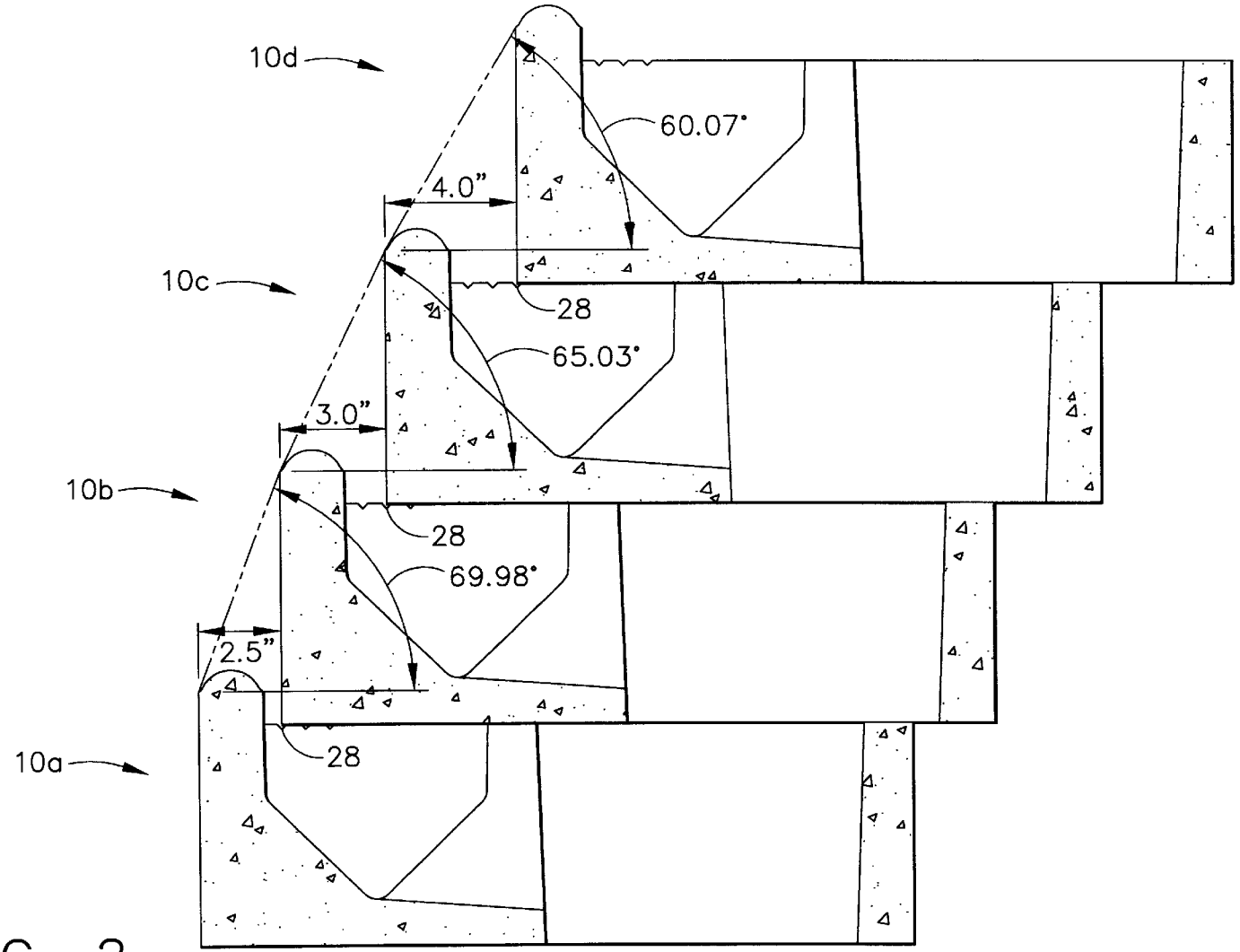
FIG. 2 is a side segmented perspective view showing multiple units layered using the angle of installation guides in accordance with the present invention.

As shown in FIG. 2, when multiple units 10*a*, 10*b*, 10*c* and 10*d* are stacked to form a retaining wall system, guides 28 determine the face setback or vertical placement of units 10 upon each other. When front guides 28 are employed, unit 10*b* has a face setback of 2.5 inches from unit 10*a*. When middle guides 28 are employed, unit 10*c* has a face setback of 3.2 inches from unit 10*b*. When rear guides 28 are employed, unit 10*d* has a face setback of 4.0 inches from unit 10*c*. In this manner, a wall having layers of different face setbacks may be built, or alternatively a wall having the same face setback for all layers may be built.

Guides 28 also determine the angle of repose between layers of units 10. The angle of reposal between layers may be any angle and is preferably between 60–70°. By using front guides 28, an angle of approximately 70° is achieved between unit 10*a* and stacked unit 10*b*. By using middle guides 28, an angle of approximately 65° is achieved between unit 10*b* and stacked unit 10*c*. By using rear guides 28, an angle of approximately 60° is achieved between unit 10*c* and unit 10*d*. In this manner, a wall having layers of different angles of repose may be built, or alternatively a wall having the same angle of repose for all layers may be built.

Figure 5:
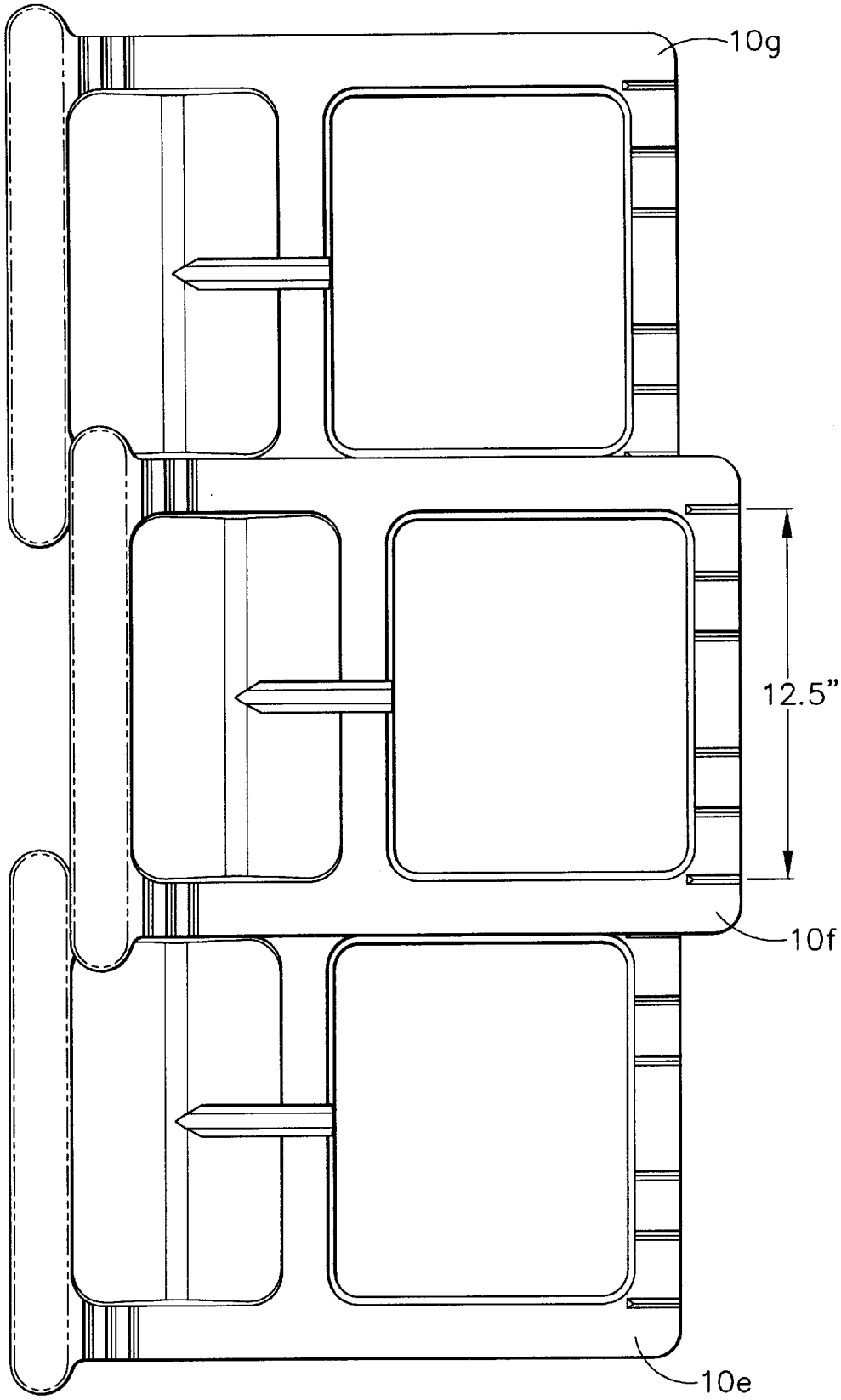
FIGS. 5, 6, and 7 are top views of multiple units layered using the horizontal alignment guides in accordance with the present invention.
Figure 6:
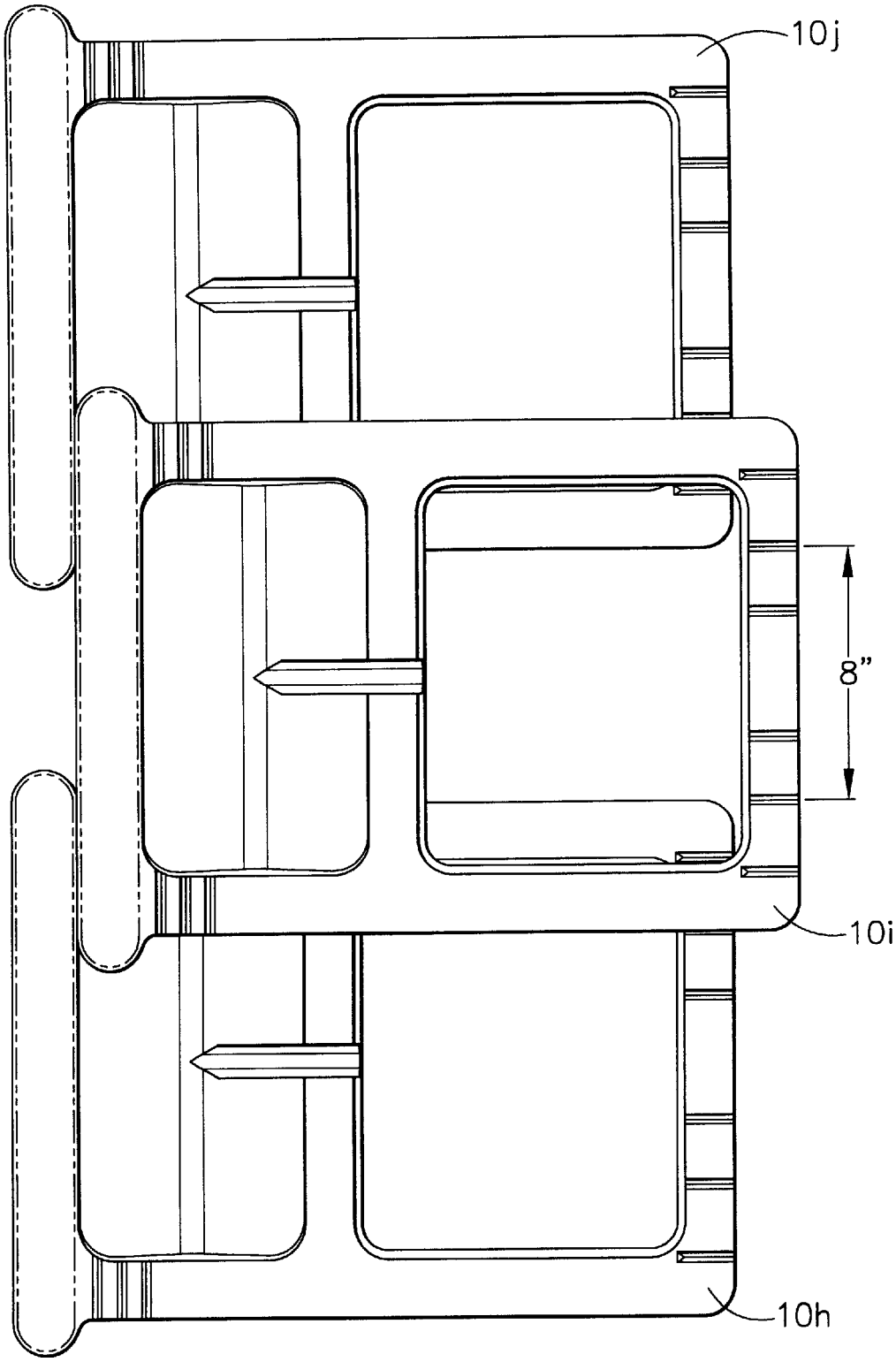
Figure 7:
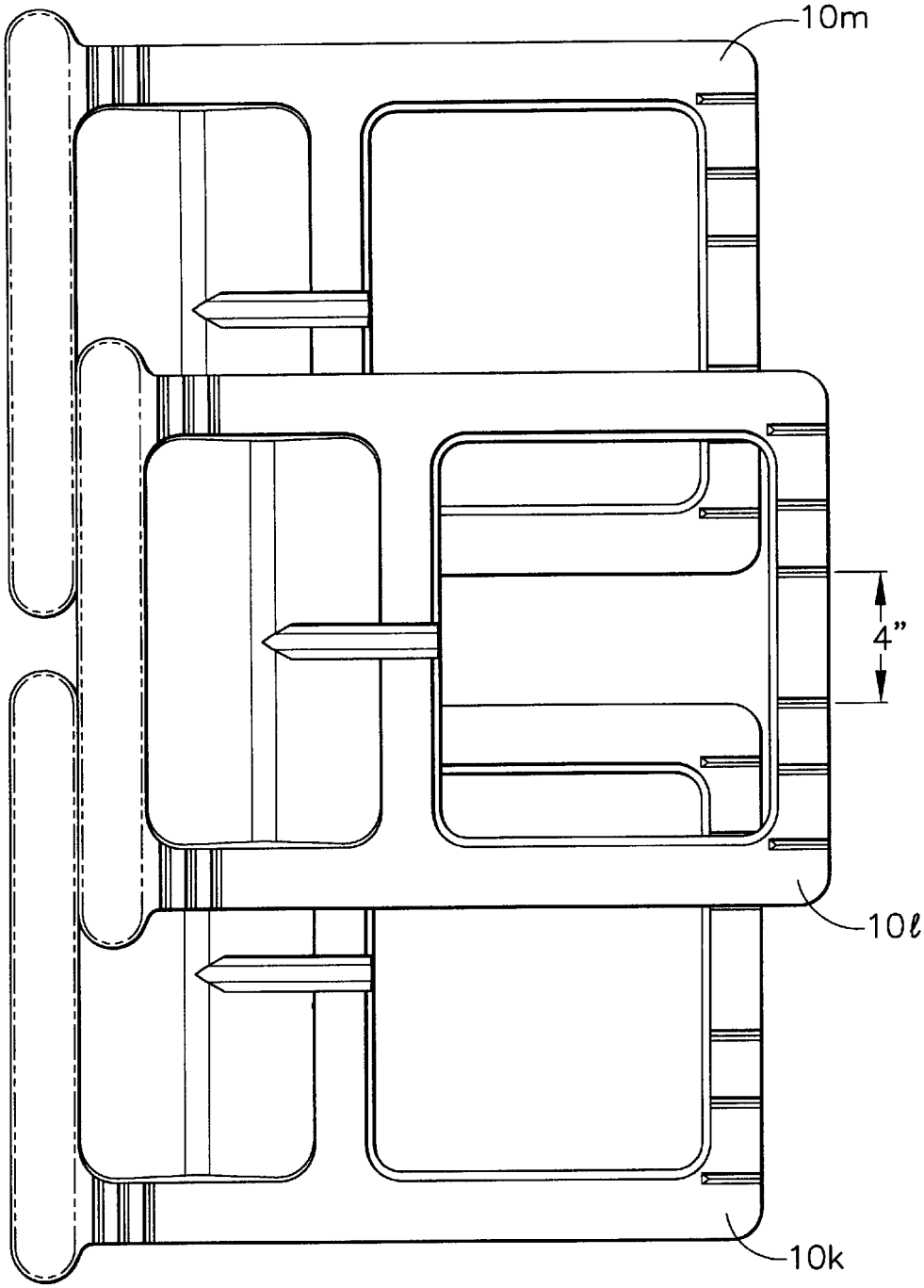

As shown in FIG. 1, rear face 20 contains horizontal alignment guides 30. Preferably, there are six guides 30 upon the top of rear face 20. Preferably, the two outermost guides are placed on each side of the center of rear face 20 approximately 6.25 inches from the center. Preferably, the two middle guides 30 are placed on each side of the center of rear face 20 approximately 4 inches from the center. Preferably, the two inner guides 30 are placed on each side of the center of rear face 20 approximately 2 inches from the center. As shown in FIGS. 5, 6, and 7, horizontal guides 30 determine the horizontal placement of units 10 when stacked upon each other in layers. FIG. 5 shows unit 10*f* placed upon the outermost guides 30 of units 10*e* and 10*g*. When outer guides 30 are used to horizontally align units 10, there are approximately 12.5 inches between units 10*e* and 10*g* of the same layer. FIG. 6 shows unit 10*i* placed on the middle guides 30 of units 10*h* and 10*j*. When middle guides 30 are used to horizontally align units 10, there are approximately 8 inches between units 10*h* and 10*j* of the same layer. FIG. 7 shows unit 101 placed upon the innermost guides 30 of units 10*k* and 10*m*. When inner guides 30 are used to horizontally align units 10, there are approximately 4 inches between units 10*k* and 10*m* of the same layer.

In this manner, guides 30 determine the side-to-side distance between units 10 and the overall width of the retaining wall system. A wall using the same guides 30 creating consistent side-to-side distance between units 10 may be built, or a wall using different guides 30 creating inconsistent side-to-side distance may be built.

To build a retaining wall system in accordance with the present invention, a space is dug into a hill or other embankment that is sufficient to place a unit 10 therein. The space is generally leveled. After unit 10 is placed into the hillside, angular gravel or other hydro-drainage material is placed in rear compartment 14, and soil, vegetation or other plantable material is placed in front compartment 12. One or more units 10 are placed adjacent the first unit 10 at side-to-side distances of either 4 inches, 8 inches or 12.5 inches apart depending upon which guides 30 are employed and the preferred overall retaining wall width. The first compartment 12 of each unit 10 is filled with soil and/or vegetation, and the second compartment 14 of each unit 10 is filled with angular gravel, such as #57 crushed limestone or other hydrodrainage material. In this manner, the first layer of units 10 is built.

A second layer of units 10 is built upon the first layer by placing units 10 of the second layer into guides 28 and 30 of the units 10 in the first layer. Which guides 28 and 30 are used (i.e. first, middle or rear guides 28, and outermost, middle or inner guides 30) depends upon desired face setback, angle of repose, and horizontal alignment. Each unit 10 of the second layer is placed between two units 10 of the first layer upon guides 28 and 30.

In this manner, multiple layers of units 10 may be added, and a retaining wall system of desired height, width and angle of repose is built. Based upon the preset angle of installation guides 28, horizontal alignment guides 30 and the weight of each unit 10, a retaining wall of up to 8 feet tall may be built in accordance with the present invention without the use of geogrid reinforcement.

As depicted in the chart shown in FIG. 9, the maximum safe wall height varies depending upon method, unit size, face setback and wall inclination. For example, using the NCMA SRWall Method, which is well-known in the art and based upon hinge height, for a block that is 21.63 inches long, used with a face setback of 2.55 inches and an inclination of 20° from vertical and horizontal backfill, a retaining wall system of approximately 6 feet and 5 inches may be safely built without the use of geogrid reinforcement. As shown in FIG. 9, by using the NCMA SRWall Method, a wall of up to seven feet and seven inches may be built without the use of geogrid by using a unit 10 that is 23.63 inches long, a face setback of 2.55 inches and an angle of repose of 20°.

Similarly, using the HCN Method, which does not consider hinge height, for a block that is 21.63 inches long, used with a face setback of 2.55 inches and an inclination of 20°, a retaining wall system of approximately 8 feet and two inches may safely be built. The HCN Method uses fundamental static equilibrium and basic geotechnical methods to derive equations to determine sliding and overturning of a non-reinforced gravity retaining wall. As shown in FIG. 9, by using the HCN Method, a wall of up to eight feet and nine inches may be built without the use of geogrid by using a unit 10 that is 23.63 inches long, a face setback of 2.55 inches and an angle of repose of 20° and level backfill.

For the HCN Method, FIG. 9 also shows the minimum controlling factor of safety which in this case is controlling lateral sliding of the segmental units.

As shown in FIG. 9, by using the HCN Recommended Method, a wall of exposed height of up to eight feet and two inches may be built without the use of geogrid by using a unit 10 that is 23.63 inches long, a face setback of 2.55 inches and an angle of repose of 20 °.

For each method, FIG. 9 also depicts the equivalent number of courses of segmented block which corresponds to the wall height.

I claim:

1. A unit for building a retaining wall system comprising:

a front face;

a middle face;

a rear face;

two side walls;

wherein said front face, said middle face, and said side walls form a front compartment having a single drainage channel that drains liquid from said front compartment into a rear hydro-drainage compartment;

wherein said middle face, said rear face, and said side walls form said rear hydro-drainage compartment that is open on its bottom and positioned behind said front compartment;

wherein each said side wall is further comprised of at least one wedge-shaped angle of installation guide that is at an angle of about 90° to create an angle of repose between a first said unit and a second said unit where said second unit is placed upon said first unit onto said at least one angle of installation guide, and wherein said at least one angle of installation guide creates a face setback between a first said unit and a second said unit;

wherein said rear face is comprised of at least one horizontal alignment guide, wherein said at least one horizontal alignment guide determines side-to-side placement of a first said unit relative to a second said unit, where said first unit is placed upon a second said unit onto said at least one horizontal alignment guide;

wherein said front face and said middle face are further comprised of angled portions forming said drainage channel which is angled from said front compartment into said rear compartment such that its highest point is in said front conpartment;

and wherein said middle face is further comprised of a cut-out portion where said drainage channel drains liquid from said front compartment through said cut-out portion into said rear compartment.

2. A retaining wall comprising one or more units:

wherein each said unit is comprised of a front face, two side walls, a middle face and a rear face;

wherein said front face, said side walls and said middle face form a first compartment having a drainage channel that drains liquid from said first compartment into a second compartment;

wherein said middle face, said side walls and said rear face form said second compartment that is positioned behind said first compartment and said second compartment is open on its bottom;

wherein said drainage channel is angled from said first compartment into said second compartment such that its highest point is in said first compartment;

wherein said middle face is further comprised of a cut-out portion, and said drainage channel drains liquid from said first compartment through said cut-out portion into said second compartment;

wherein said one or more units are placed side-by-side to form one or more layers;

wherein each said side wall is further comprised of at least one wedge-shaped angle of installation guide, wherein said at least one angle of installation guide is wedge-shaped at an angle of about 90° to create an angle of repose between a first said unit and a second said unit where said second unit is placed upon said first unit onto said at least one angle of installation guide, and wherein said at least one angle of installation guide creates a face setback between a first said unit and a second said unit;

wherein said rear face is further comprised of at least one horizontal alignment guide, wherein said at least one horizontal alignment guide determines side-to-side placement of a first said unit relative to a second unit when said first unit is placed upon said at least one horizontal alignment guide of said second unit;

wherein said front face and said middle face each contain angled portions that meet to form a bottom portion to hold planting material within said first compartment;

and wherein soil is placed in said first compartment and angular gravel is placed in said second compartment.

* * * * *